US005272681A

United States Patent [19]

Lee

[11] Patent Number: 5,272,681

[45] Date of Patent: Dec. 21, 1993

[54] DYNAMIC FLUID CLOCK

[76] Inventor: Vincent K. W. Lee, No. 44, Lane 458, Sheh Chung Street, Taipei, Taiwan

[21] Appl. No.: 49,108

[22] Filed: Apr. 16, 1993

[51] Int. Cl.[5] ..... G04B 1/26; G04B 19/00; G04B 37/00

[52] U.S. Cl. ..... 368/62; 368/65; 368/76; 368/223; 368/285

[58] Field of Search ..... 368/10, 62, 65, 76, 368/80, 223-228, 276, 285

[56] References Cited

U.S. PATENT DOCUMENTS

| | | | |
|---|---|---|---|
| 2,796,237 | 5/1956 | Anderson | 368/285 |
| 3,938,315 | 2/1976 | von Kemehezft | 368/65 |
| 4,228,649 | 10/1980 | Weiss | 368/93 |
| 4,945,523 | 7/1990 | Lam | 368/285 |

*Primary Examiner*—Vit W. Miska
*Attorney, Agent, or Firm*—Bacon & Thomas

[57] ABSTRACT

A structure of dynamic fluid clock which can serve both functions of time indication and dynamic enjoyment provided by the fluid, characterized in by its utility and dual functions that conventional timepiece products are hard to serve.

5 Claims, 5 Drawing Sheets

DYNAMIC FLUID CLOCK

BACKGROUND OF THE INVENTION

Although there are various types and styles and styles in the conventional timepiece products, we can hardly find products with specialty and novelty. In spite of a little variation made in the appearance and shaping, most products were designed in the form of traditional style. Therefore, this kind of products has been, for a long time, confined in the function that simply indicate the time.

There is no way for the clock products to break through the conventional limitation, whereas these products can only be adaptive to the trend and tide of popularity. Moreover, the second hand of traditional clock is so tiny that it is hard for us to instantaneously identify the movement of the second hand. Unfortunately, consumers usually check the operational normality of the timepiece by customarily inspecting the movement of the second hand. The deficiency that can not fully meet the consumer's requirements frequently come out in the conventional timepiece products, which greatly effect the effectiveness and value of these products.

It is an object of the present invention to mitigate the problems and deficiencies of the conventional clock products by providing a structures of dynamic fluid clock with simplified construction and assembly process. The indication of said clock is not only free from the deficiency of indefinite movement of the second hand, also the dynamic scenery, composed of the fluid and floating means in the fluid ornament apparatus, can be shown by means of the second hand. Besides the indication of the time, the further function of enjoyment can also be achieved.

SUMMARY OF THE INVENTION

The invention relates to a structure of dynamic fluid clock and more specifically to a novel structure of clock which can additionally serve the functions of enjoyment and ornament during the operation of time indication. The structure of the invention: transparent case which is segregated into upper space and lower space; fluid ornament apparatus and desk clock which are respectively placed into said upper space and said lower space. The floating means of fluid ornament apparatus in the upper space is drawn by a thread, and the other end of the thread is connected to a magnetic means which is located at the bottom surface of the fluid. A magnetic apparatus, incorporated in the second hand of the desk clock in the lower space, can attract, by means of magnetic force, the magnetic means to move along with it accordingly during its operation for time indication, so that the dynamic floating scenery of floating means drawn by the magnetic means can be generated. The invention is thus characterized by the additional function of enjoyment besides the time indication.

DETAILED DESCRIPTION OF THE PREFERRED EMBODIMENT

Figure 1:
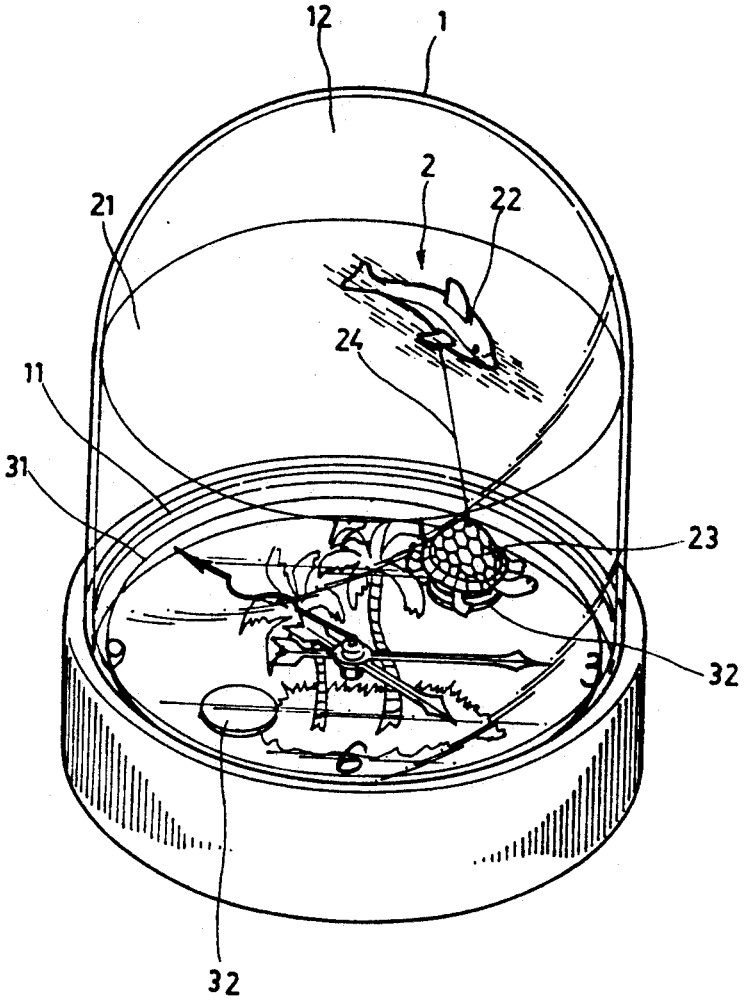
FIG. 1 is a perspective drawing of the present invention.
Figure 2:
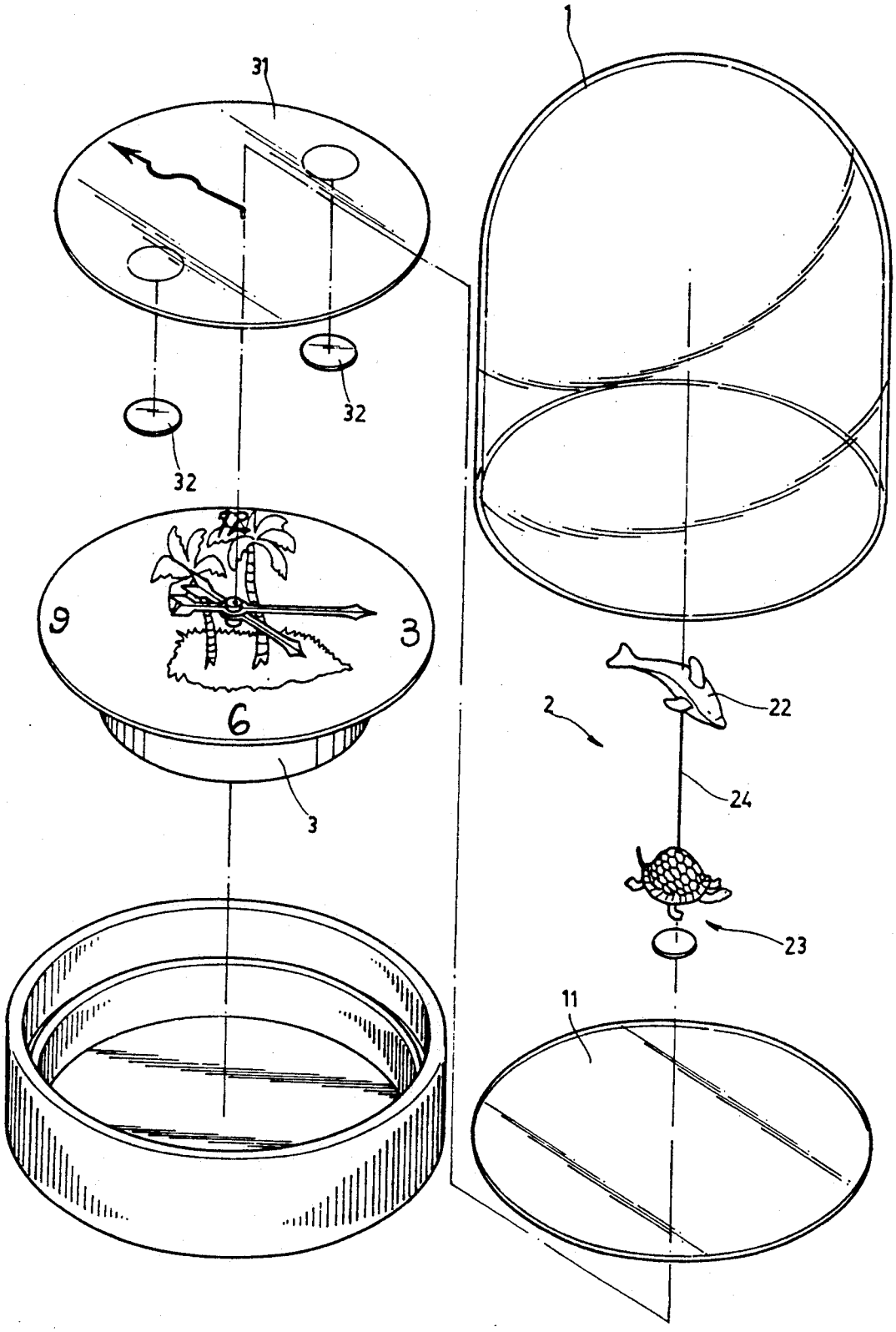
FIG. 2 is a perspective drawing to illustrate the individual components of the present invention.
Figure 3:
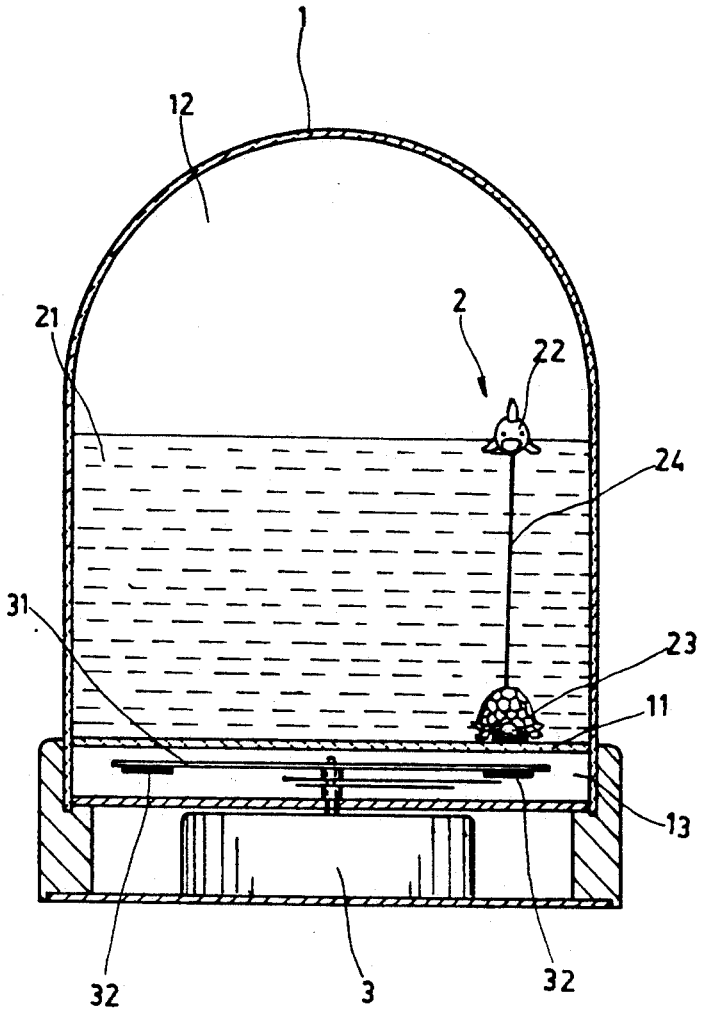
FIG. 3 is a sectional view of the assembled structure according to the present invention.
Figure 4:
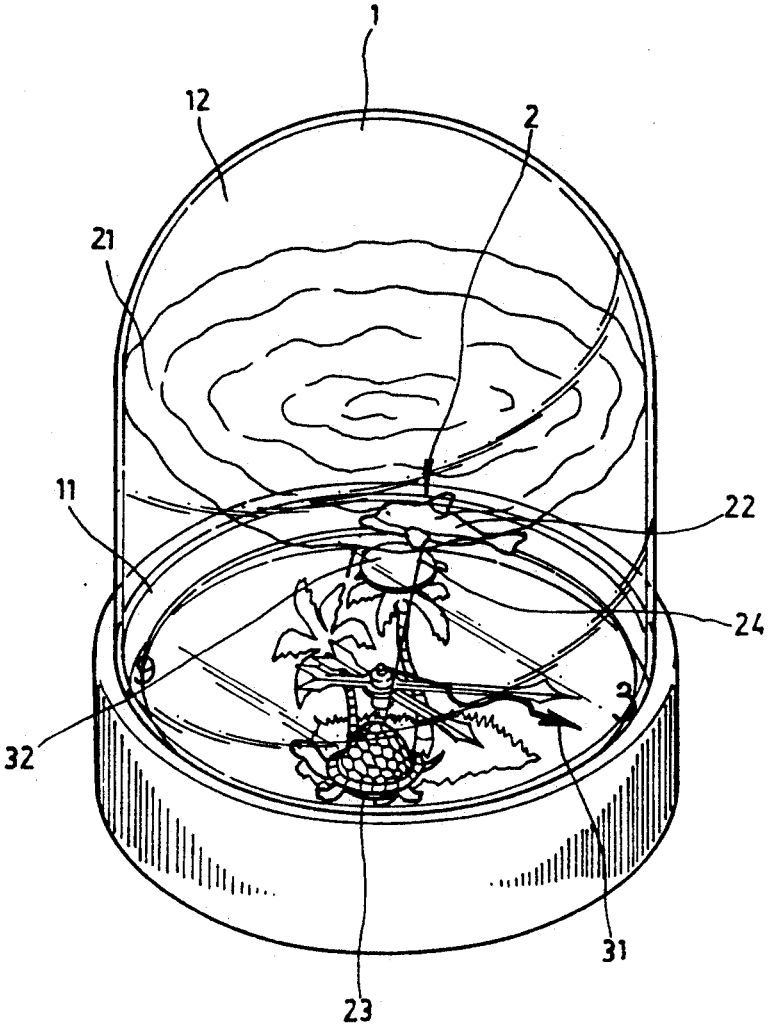
FIG. 4 is a diagram to illustrate the use status of one embodiment according to the present invention.
Figure 5:
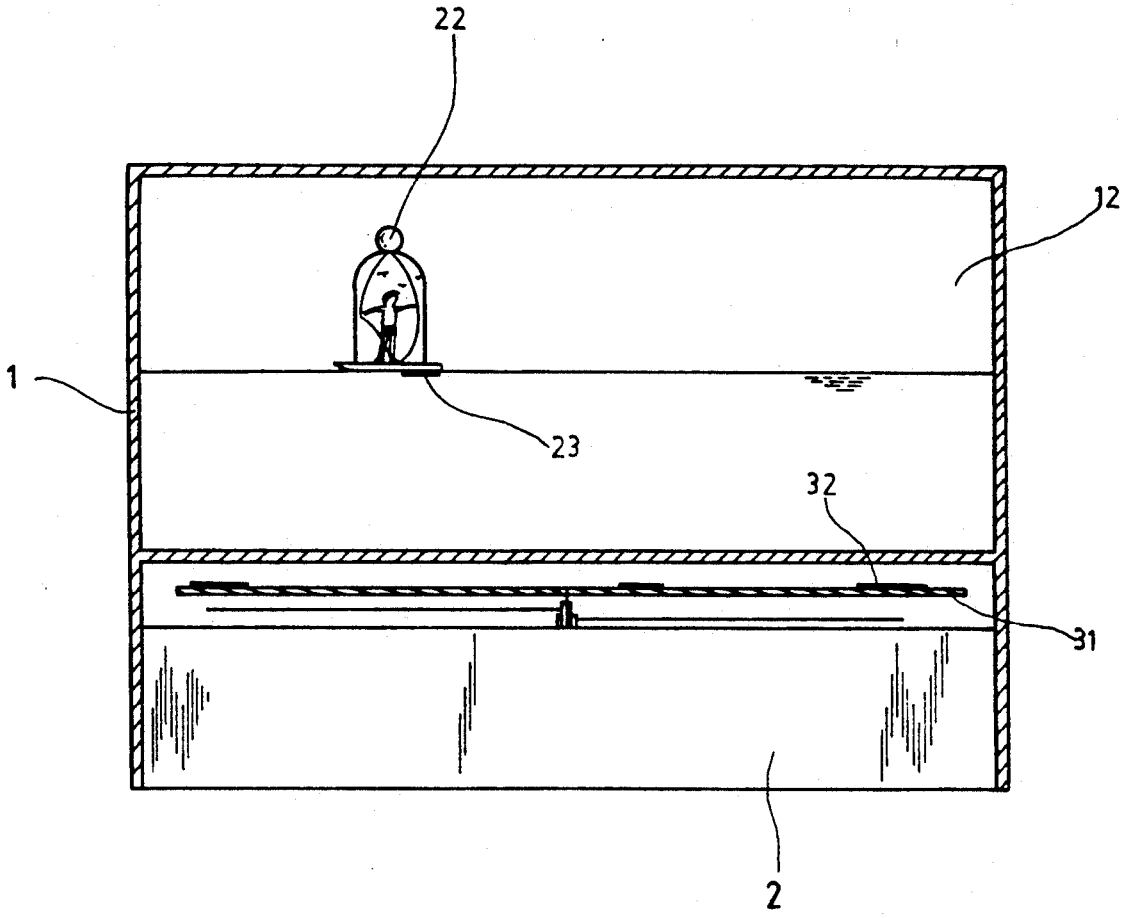
FIG. 5 is a diagram to illustrate the use status of another embodiment according to the present invention.

Please refer to FIGS. 1, 2 and 3 which are the perspective drawing of the present invention, the perspective drawing of individual components of the present invention, and the sectional view of the assembled structure according to the present invention respectively. The structure of the dynamic fluid clock according to the present invention includes transparent case 1, fluid ornament apparatus 2 and desk clock 3. The transparent case is a transparent container member without limitation of shaping, wherein one piece of thin transparent lamination 11 segregates the interior of transparent case 1 into upper space 12 and lower space 13 which can not be passed through. A fluid ornament apparatus 2 is placed into the upper space 12, and a desk clock 3 is placed into the lower space 13. The fluid ornament apparatus 2 is composed of fluid 21, floating means 22 and magnetic means 23. The floating means 22 is not limited by its appearance and shape, but shall form a certain of floating status in the fluid 21. The magnetic means 23 is also not limited by its appearance and shape in order to be incorporated a two different amusing shapes by matching with floating means 22, but the magnetic means 23 shall have adequate weight to sink in the fluid 21 and shall be able to be attracted by other magnetic apparatus. A thread 24 is fitted between the magnetic means 23 and floating means 22, so that the operation and displacement of the magnetic means 23 can draw the operation and displacement of floating means 22 accordingly through the thread 24. The desk clock 3 is a set of clock member facing upwardly which is installed by matching with the shape and range of the lower space in the case 1. A second hand 31 is incorporated in the toppest end of the central rotation shaft of the desk clock 3. The second hand 31 may be incorporated in various shapes such as round dish shape, semi-round dish shapefan shape or single pointer shape . . . etc. On the conditions that the design of the second hand 31 shall not affect its movement to indicate time, and shall not change the frequency. A plurality of magnetic apparatus 32 are incorporated in the adequate locations of the second hand 31, so that the magnetic apparatus 32 can move along with the operation of second hand 31. The said magnetic apparatus 32 can attract and drive the magnetic means 23 in the fluid ornament apparatus 2, but the attraction status generated by magnetic force shall be designed as proper energy in order to drive the magnetic means 23 without affecting the accuracy of time indication. The overall structure is assembled by placing the fluid ornament apparatus 2 into the upper space 12 end the desk clock 3 into the lower space 13. The floating means 22 of the fluid ornament apparatus 2 then stays in the fluid 21, and the magnetic means 23 sinks and attaches the top surface of the transparent lamination 11. The threat 24 is connected between floating means 22 and the magnetic means 23 in order to draw the floating means 22. The second hand 31, minute hand and hour hand of the desk clock 3 in the lower space 13 carry out the time indication for user to view the time status from outside. When the second hand 31 carry out its slow rotary movement, the magnetic apparatus 32 in the second hand 31 is driven to rotary movement accordingly, which will attract magnetic means 23 for a corresponding displacement. The displacement of the magnetic means 23 will draw the operation of magnetic means 23 through the thread 24, so that the floating means 22 comes out the dynamic swimming status in the fluid 21 in the manner that is similar to the living creature floating in the wave. As shown in FIG. 4, the invention is novel and unique as consumers can not only benefit from the enjoyment and fun besides time indication, they can also definitely identify the operational normality of the second hand 31 by simply viewing the operation of the floating means 22. While the invention has been described in conjunction with a specific embodiment, it is not intended to limit the present invention to the description as set forth herein, and many variations and modifications can be made without departing from the spirit and scope the present invention. For example, varied the external shape of the present invention and integrating the floating means 22 and magnetic means 23 into a apparatus, as shown in FIG. 5, shall also be included in the scope of the present invention.

I claim:

1. A dynamic fluid clock including transparent case which is segregated into upper space and lower space; fluid ornament apparatus and desk clock which are respectively placed into said upper space and said lower space, said dynamic fluid clock characterizing by:

a floating means of said fluid ornament apparatus in said upper space being drawn by a thread, and the other end of said thread being connected to a magnetic means which is located at the bottom surface of said fluid;

a magnetic apparatus, incorporated in a second hand of said desk clock in said lower space, attracting said magnetic means by means of magnetic force to move along with it accordingly during its operation for time idication; and a dynamic floating scenery of said floating means drawn by said magnetic means being generated.

2. A dynamic fluid clock according to claim 1, wherein said transparent case is a transparent container member without limitation of shaping, and one piece of thin transparent lamination segregates the interior of said transparent case into said upper space and said lower space.

3. A dynamic fluid clock according to claim 1, wherein said fluid ornament apparatus, being placed into said upper space of said case, is composed of said fluid, said floating means and said magnetic means, and said floating means is not limited by its appearance and shape but shall form a certain of floating status in said fluid; said magnetic means is also not limited by its appearance and shape in order to be incorporated as two different amusing shapes by matching with said floating means, but said magnetic means shall have adequate weight to sink in said fluid and shall be able to be attracted by said magnetic apparatus; and said thread is fitted between said magnetic means and said floating means, so that the operation and displacement of said magnetic means can draw the operation and displacement of said floating means accordingly through said thread.

4. A dynamic fluid clock according to claim 3, wherein said magnetic means and floating means in said fluid ornament apparatus may be varied and combined into one floating apparatus which can be attracted by said magnetic apparatus.

5. A dynamic fluid clock according to claim 1, wherein said desk clock is placed into a clock member in said lower space of said case, in which the clock surface and said second hand of said desk clock are toward the bottom surface of said transparent lamination, and said second hand is incorporated in the topmost end of a central rotation shaft of said desk clock; and wherein said second hand may be incorporated in various shapes such as round dish shape, semi-round-dish shape, fan shape or single pointer shape etc, and a plurality of said magnetic apparatus are incorporated in the adequate locations of said second hand, so that said magnetic apparatus, responsive to the rotary displacement of said second hand, can move accordingly and drive the operation of said magnetic means.

* * * * *